United States Patent [19]

Balzer et al.

[11] Patent Number: 4,542,707

[45] Date of Patent: Sep. 24, 1985

[54] SEWING MACHINE HAVING AUXILIARY WORK TURNING NEEDLE

[75] Inventors: Dieter Balzer, Heiligenmoschel; Walter Hager, Kaiserslautern, both of Fed. Rep. of Germany

[73] Assignee: Pfaff Industriemaschinen GmbH, Fed. Rep. of Germany

[21] Appl. No.: 627,791

[22] Filed: Jul. 5, 1984

[30] Foreign Application Priority Data

Jul. 19, 1983 [DE] Fed. Rep. of Germany ... 8320716[U]

[51] Int. Cl.[4] ..... D05B 35/04

[52] U.S. Cl. ..... 112/310; 112/DIG. 3; 112/121.11; 112/131; 112/221

[58] Field of Search ..... 112/48, 121.11, 310, 112/DIG. 3, 221, 131, 85, 89, 98, 102

[56] References Cited

U.S. PATENT DOCUMENTS 1,330,601 2/1920 Miller ..... 112/131
3,948,194 4/1976 Gunold ..... 112/131
4,366,763 1/1983 Teetz et al. ..... 112/98
4,388,880 6/1983 Ciucani ..... 112/310

FOREIGN PATENT DOCUMENTS 1685079 5/1976 Fed. Rep. of Germany .
2407941 8/1984 Fed. Rep. of Germany ..... 112/310

*Primary Examiner*—Werner H. Schroeder
*Assistant Examiner*—Andrew M. Falik
*Attorney, Agent, or Firm*—McGlew and Tuttle

[57] ABSTRACT

An auxiliary needle is supported by a shiftable and rotatable slide rod which extends in a slightly inclined position relative to the vertical and is guided by an extension in a guide slot. The upper portion of the guide slot extends at an angle relative to the slide rod. Therefore, if moved from its rest position downwardly into its working position, the auxiliary needle performs first a combined rotary and translational motion, and then, upon penetrating a workpiece, only a straight longitudinal motion.

5 Claims, 2 Drawing Figures

50
32
31
30
29
24
9
25
15
14
23
17
16
1
3
21
4
22
5
19
20
2

50
32
14
31
29
24
9
1
27
18
17
3
4
22
5
28
26
25
15
16
6
19
21
II
II
V
2
10
11
10
8
7
13
12
13

SEWING MACHINE HAVING AUXILIARY WORK TURNING NEEDLE

FIELD AND BACKGROUND OF THE INVENTION

This invention relates in general to sewing machines and in particular to a new and useful sewing machine which has, in addition to ordinary sewing needles, an auxiliary needle which is engageable into the workpiece to facilitate the turning thereof during stitching or feeding.

A similar machine is disclosed in German patent 16 85 079 (U.S. Pat. No. 3,425,369). According to this reference, if seams parallel to the edge and forming a corner are sewn with multineedle sewing machines, the sewing machine is stopped with the needles in their upper dead center position, and an auxiliary needle is thrust into the work at the corner point of the provided outer seam, whereupon the work can be turned into a new direction about the auxiliary needle which now serves as an axis of rotation. Since, in its rest position, the auxiliary needle must extend outside the range of motion of the needle bar or the needle holder supporting the sewing needle, it must move along a path forming a relatively large angle with the vertical, and, consequently, pierces the work obliquely. Because of this oblique piercing direction, and provided that it is adjusted for a medium thickness of the work, the auxiliary needle penetrates the work ahead of, or behind, the predetermined corner point of the seam, depending on whether the work is particularly thick or particularly thin, whereby upon turning the work, the seam is misplaced relative to the edge.

SUMMARY OF THE INVENTION

The invention is directed to a sewing machine having an auxiliary needle which penetrates the work at an angle which is as steep as possible and in the corner point of the seam.

Due to an inventive mounting, the movement of the auxiliary needle comprises a longitudinal motion and a superposed rotary motion, so that in its rest position, the auxiliary needle remains sufficiently spaced from the path of motion of the needle bar or the needle holder carrying the sewing needle.

In another embodiment, the auxiliary needle is rotated only in the upper portion of its path of motion. The auxiliary needle is carried by a slide rod. During a downward movement of the slide rod, and as soon as an extension of the slide rod enters the lower portion of a guide slot which extends parallel to a longitudinal axis of the rod, the auxiliary needle moves only straight, so that it pierces the work without any lateral motion component.

Accordingly it is an object of the invention to provide a sewing machine which has one or more stitch forming needles with an additional needle or auxiliary needle which is carried by a movable member or slide rod which may be extended to present the needle into the material to be sewn and which is advantageously guided so that the needle will first rotate as it is moved initially and then, after penetrating the work, it will move in a straight line.

A further object of the invention is to provide a sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 2:
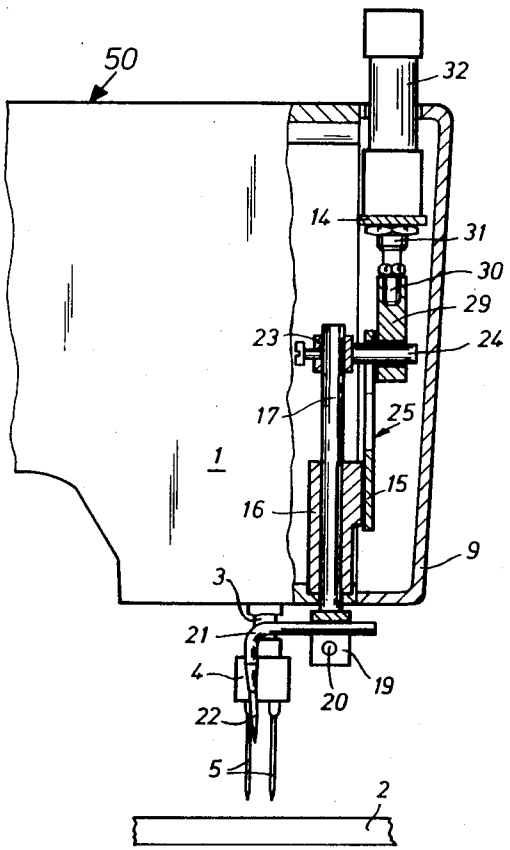
FIG. 2 is a rear view taken along the line II—II of FIG. 1, showing the head of the sewing machine, with a drive mechanism for the auxiliary needle being shown in section.

Referring to the drawings in particular the invention embodied therein comprises a sewing machine generally designated 50 which has a base plate 2 over which material is fed in a direction indicated by the arrow designated V. The material is advanced in the work feed direction V by a feeding mechanism including feed dogs 11 cooperating with a presser foot 7 under which the material is fed. In accordance with the invention in addition to one or more stitching needles 5 which are reciprocated so as to penetrate into the workpiece and which cooperate with a rotatable hook or bobbin (not shown), the invention provides an auxiliarly needle 21 which has a point 22 which is adapted to penetrate into the material to facilitate a turning movement thereof around the auxiliary needle point.

The sewing machine includes a housing head 1 which extends over plate 2. In head 1, a needle bar 3 which is mounted for up and down movement in a manner known per se, carries two needles 5 supported in a needle holder 4. The two sewing needles 5 are spaced apart from each other, transversely to work feed direction V, and cooperate with rotary hooks (not shown) which are accommodated in the base plate. Further mounted in housing head 1 is a presser bar 6 carrying the presser foot 7. With presser bar 6 lowered, presser foot 7 rests on a needle plate 8 supported on base plate 2. The front side of housing head 1 is closed by a cover 9. Also provided in base plate 2 are the feed dogs 11 protruding through slots 10 of needle plate 8 and effecting a four component type feed which is known per se.

To the rear side of housing head 1, a support 12 is secured comprising two fixing lugs 13, a holding plate 14, and a guide plate 15. Guide plate 15 supports a bearing bushing 16 in which a slide rod 17 is received for displacement and rotation, having an axis 18. Axis 18 of rod 17 forms an angle $\alpha$ with the vertical needle bar 3.

On its lower end, slide rod 17 carries a slotted needle holder 19 in which the auxiliary needle 21 bent to an angle and having point 22, is adjustably clamped by means of a screw 20. Point 22 of needle 21 is off-set from the axis 18 of rod 17. On its upper end, slide rod 17 carries a pin 24 which projects perpendicularly from the rod and is secured thereto through a clamp 23. Pin 24 is received for displacement in a guide slot 25 which comprises an upper portion 26 extending at an angle $\beta$ relative to the longitudinal axis 18 of slide rod 17, and a lower portion 27 extending parallel to longitudinal axis 18. The width of lower portion 27 substantially corresponds to the diameter of the pin 24. The upper portion 26 of the slot 25 is wider by an amount corresponding to the oblique position of pin 24 within guide slot 25.

The free end of pin 24 projects out of guide slot 25 and is received in a horizontally extending oblong hole 28 of an engaging plate 29. Engaging plate 29 is secured to a threaded extension 30 provided on a piston rod 31 of an air cylinder 32. Air cylinder 32 is secured to holding plate 14 of support 12.

Figure 1:
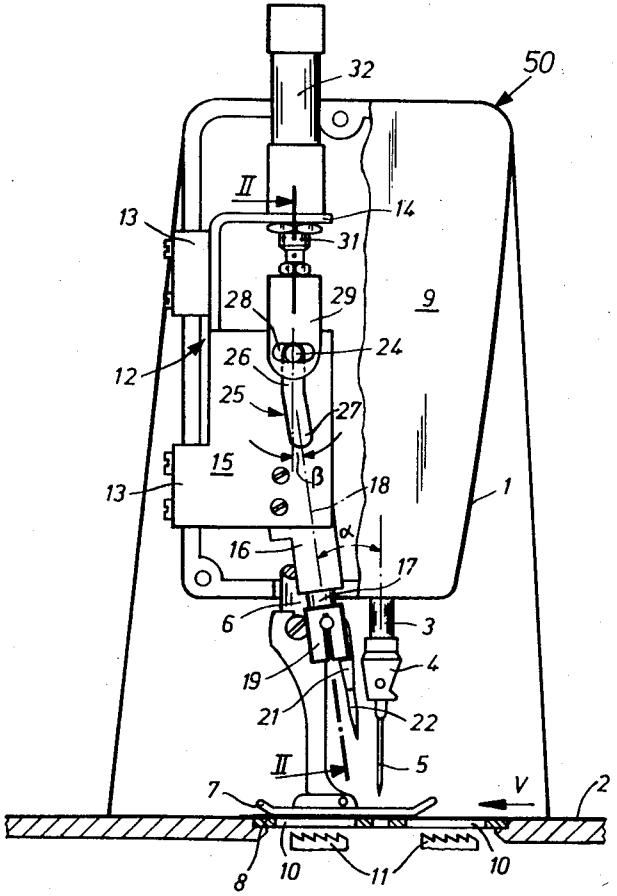
FIG. 1 is a side elevation, partly in section, of a sewing machine with the auxiliary needle and the drive mechanism thereof.

In its rest position shown in the FIGS. 1 and 2, auxiliary needle 21 is lifted from needle plate 8 to an extent such that the handling of the work is not hindered. At the same time, the auxiliary needle is sufficiently laterally spaced away from needle bar 3, so that it remains outside the range of motion of needle holder 4.

After the next-to-last stitches in two seams being produced by the two sewing needles 5, the sewing machine forms only a part of the last stitches of these seams wherein the last perforation of the outer most seam is to be made at the corner point for the seam. The sewing machine is stopped at the instant at which feed dog 11 has terminated its advance step and sewing needles in the feed direction 5 are in a position only a few millimeters above the respective location where the perforation for the last stitch is to be made in the work. At this time, air cylinder 32 is actuated, so that engaging plate 29 and pin 24 as well as slide rod 17 are moved downwardly.

As long as pin 24 moves within upper portion 26 of guide slot 25, slide rod 17 moves downwardly and, at the same time, rotates about its axis 18 with bushing 16, by an amount depending on angle so that auxiliary needle 21 with point 22 is pivoted in the direction of sewing needle 5 producing the outer seam. This pivoting is due to the fact that point 22 is off-set from axis 18. As soon as pin 24 enters the lower portion 27, slide rod 17 and auxiliary needle 21 move farther in only straight line, in their longitudinal directions. Toward the end of this motion, the point 22 of auxiliary needle 21 pierces the work at the location where the longitudinal axis of sewing needle 5 producing the outer seam intersects the work. This location will later form the corner point of the outer seam. Since slide rod 17 is inclined relative to the vertical only slightly, auxiliary needle 21 pierces the work, with a satisfactory accuracy right at the location which will form the corner point of the outer seam whether the work is very thick or very thin.

At the end of the downward movement of slide rod 17, the point 22 of auxiliary needle 21 has penetrated into the work so deeply that subsequently, upon lifting presser foot 17, the work can be turned about auxiliary needle 21 into a further sewing direction. After turning the work, auxiliary needle 21 is lifted into its rest position, and the temporarily interrupted stitch forming operation can continue.

In this embodiment, auxiliary needle 21 is associated with the sewing needle 5 at the left in FIG. 2. It is thus assumed that the work will be turned about auxiliary needle 21 counterclockwise. If for any reason, the work is to be turned clockwise, auxiliary needle 21 is displaced within the holder 19 and pointed at the work piercing point of the sewing needle 5 which is shown at the right hand side in FIG. 2.

While a specific embodiment of the invention has been shown and described in detail to illustrate the application of the principles of the invention, it will be understood that the invention may be embodied otherwise without departing from such principles.

What is claimed is:

1. A device for use with a sewing machine having at least one stitching needle which reciprocates into a workpiece that is fed over a support to form stitches, comprising an auxiliary needle having a point, a slide rod connected to said auxiliary needle and having a longitudinal axis which is offset from said point, a bushing mounted at a fixed location with respect to the sewing machine, said bushing carrying said slide rod for longitudinal movement parallel to its axis and for rotation about its axis, drive means operatively connected to said slide rod for moving said slide rod and guide means engaged with said slide rod for guiding movement of said slide rod through a path having a first portion effecting rotation of said slide rod about its axis, and a second portion for effecting only longitudinal movement of said guide rod along its axis, said rotation of said guide rod causing pivotal displacement of said auxiliary needle point to a penetration location whereby movement of said slide rod in said second portion of said path causes penetration of said point into the workpiece.

2. A device according to claim 1, including a guide plate having a guide slot, said slide rod having an extension extending into said guide slot controlling the movement of said slide rod with said auxiliary needle and comprising said guide means, said guide slot having an upper portion extending at an angle relative to the longitudinal axis of said slide rod and a lower portion extending parallel to the longitudinal axis of said slide rod.

3. A device according to claim 1, including an air cylinder having a piston slidable therein connected to said slide rod to move said slide rod.

4. A device according to claim 1, wherein said auxiliary needle includes a needle bar shank portion which includes an outer end disposed at an angle to the remaining portion thereof, said slide rod having a receiving bore into which said outer end of said shank portion extends, whereby said slide rod is positioned out of alignment with the sewing needles of said machine.

5. A device according to claim 1, wherein said guide means is shaped so that said first portion of said path causes simultaneous rotation of said slide rod about its axis and longitudinal movement of said guide rod parallel to its axis.

* * * * *